US007225880B2

(12) United States Patent
Braddick

(10) Patent No.: US 7,225,880 B2
(45) Date of Patent: Jun. 5, 2007

(54) EXPANDABLE LINER HANGER SYSTEM AND METHOD

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 405 days.

(21) Appl. No.: 10/855,044

(22) Filed: May 27, 2004

(65) Prior Publication Data

US 2005/0263292 A1 Dec. 1, 2005

(51) Int. Cl.
*E21B 23/00* (2006.01)

(52) U.S. Cl. ..... 166/382; 166/208

(58) Field of Classification Search ..... None
See application file for complete search history.

(56) References Cited

U.S. PATENT DOCUMENTS 3,948,321 A 4/1976 Owen et al.
6,648,075 B2 * 11/2003 Badrak et al. ..... 166/381
6,705,395 B2 3/2004 Cook et al.
7,093,656 B2 * 8/2006 Maguire ..... 166/277
2001/0020532 A1 9/2001 Baugh et al.
2003/0062171 A1 4/2003 Maguire et al.

FOREIGN PATENT DOCUMENTS

WO WO 00/66877 11/2000

* cited by examiner

*Primary Examiner*—Frank Tsay
(74) *Attorney, Agent, or Firm*—Browning Bushman P.C.

(57) ABSTRACT

The liner hanger assembly seals with casing 8 and supports a liner 98 within a well. The tubular liner hanger 48 and a tubular expander 40 may be position downhole on a running tool at a desired depth along the casing string 8. An actuator assembly 6 may forcably move the tubular expander 40 into the tubular hanger, expanding the liner hanger to seal and secure the hanger against the casing string 8. After the running tool has been removed, a seal nipple may be sealed to the sealing sleeve of the tubular expander. A selectively releasable clutch 73 is provided for allowing rotation of the liner to rotate the liner with the running tool, and thereafter to disengage and release the running tool from the set liner hanger.

20 Claims, 3 Drawing Sheets

EXPANDABLE LINER HANGER SYSTEM AND METHOD

FIELD OF THE INVENTION

The present invention relates to downhole tools and techniques for hanging a liner in a well. More particularly, the invention relates to forming an expandable liner hanger for grippingly engaging a casing string to support the liner in the well.

BACKGROUND OF INVENTION

Various types of liner hangers have been proposed for hanging a liner from a casing string in a well. Most liner hangers are set with slips activated by the liner hanger running tool. Liner hangers with multiple parts pose a significant liability when one or more of the parts becomes loose in the well, thereby disrupting the setting operation and making retrieval difficult. Other liner hangers and running tools cannot perform conventional cementing operations through the running tool before setting the liner hanger in the well.

Other liner hangers have problems supporting heavy liners with the weight of one million pounds or more. Some liner hangers successfully support the liner weight, but do no reliably seal with the casing string. After the liner hanger is set in the well, high fluid pressure in the annulus between the liner and the casing may blow by the liner hanger, thereby defeating its primary purpose. Other liner hangers are not able to obtain burst and/or collapse characteristics equal to that of the casing. A preferred liner hanger maintains a collapse and burst strength at least substantially equal to that of both the casing and the liner.

Liners having gripping elements and packing elements have been expanded to support a liner within the casing. However, the lengths of the liner hanger which was expanded were substantial, typically approximately ten (10) feet or more, in order to provide sufficient frictional force between the liner hanger and the casing to accommodate the liner load. Prior art designs relied upon expansion of the tubular anchor from an elastic state in which the steel lost its elasticity or memory, resulting in relaxation of the energy necessary to maintain the liner hanger at the fully expanded diameter, thus leading to a failure of sealing and suspension supporting capability.

Another significant problem with some liner hangers is that the running tool cannot be reliably disengaged from the set liner hanger. Another problem with liner hanger technology concerns the desirability to rotate the liner with the work string in the well, then disengage from the work string when the liner hanger has been set to retrieve the running tool from the well.

Publication 2001/0020532A1 discloses a tool for hanging a liner by pipe expansion. U.S. Pat. No. 3,948,321 discloses a reinforcing swage which remains downhole when the tool is retrieved to the surface. U.S. Pat. No. 6,705,395 discloses a radially expanded liner hanger which uses an axially movable annular piston to expand a tubular member.

The disadvantages of the prior art are overcome by the present invention, an improved liner hanger system and method of setting the liner hanger are hereinafter disclosed.

SUMMARY OF THE INVENTION

The expandable liner hanger system and method achieves positioning, suspension, sealing and cementing of a liner in a subterranean well. The method involves expansion of a high strength steel tubular hanger body having slips and packing elements positioned about its outer circumference, into contact with the inner surface of a casing string having a larger internal diameter than the external diameter of the liner and liner hanger.

The present invention uses a tubular expander to expand the hanger body which remains positioned inside the expanded hanger body for support at its final expanded diameter, thus sandwiching the expanded plastically deformed hanger body between the casing and the tubular expander. This method provides improved sealing and gripping capability and requires shorter lengths of expandable tubular liner hanger in the range of one to two feet.

According to one embodiment of the invention, a liner hanger for use downhole in a wellbore is provided to seal with a casing string and transmit fluid between a liner supported on the liner hanger and a production string extending upward from the liner hanger. The liner hanger comprises a tubular liner hanger removably supportable on a running tool for positioning the tubular liner hanger downhole, and a tubular expander removably supportable on the running tool, and having an expander outermost diameter greater than the initial hanger inner diameter. The running tool including an actuator which forcibly moves the tubular expander axially from a position substantially axially spaced from the tubular liner hanger to a position substantially within the tubular liner hanger, thereby radially expanding the tubular hanger against the casing string to secure the tubular expander and the tubular hanger downhole. A sealing sleeve is secured to an upper end of the tubular expander for communication between the tubular expander and the liner extending upward to the surface.

According to another embodiment, a tubular liner hanger is removably supportable on a running tool for positioning the tubular liner hanger downhole, and supporting the liner in the well. A tubular expander removably supportable on the running tool has an expander outermost diameter greater than an initial hanger inner diameter. The running tool forcibly moves the tubular expander axially from a position substantially axially spaced from the tubular liner hanger to a position substantially within the tubular liner hanger, thereby radially expanding the tubular hanger against the casing string to secure the tubular expander and the tubular hanger downhole. One or more dogs are provided each for engaging a slot in the liner to rotatably lock the one or more dogs to the liner. A clutch selectively engages and disengages rotation between a running tool mandrel and the one or more dogs, such that the liner rotates with the running tool mandrel when the clutch is engaged and the liner is rotationally disconnected from the running tool mandrel when the clutch is disengaged.

A method of hanging a liner in a well bore is also provided to seal with a casing string and transmit fluid between the liner and a production string extending upward from the liner hanger. The method comprises positioning an expandable tubular liner hanger and tubular expander on a running tool, the tubular expander having an expander outermost diameter greater than an initial liner hanger inner diameter, and a sealing sleeve secured to an upper end of the tubular expander. After positioning the liner hanger at a selected depth within a wellbore, the tubular expander is forcibly moved axially to a position substantially within the tubular liner hanger to radially expand the tubular liner hanger against the casing string, thereby securing the tubular liner hanger and the tubular expander downhole. The liner may extend upward from the tubular expander.

It is a feature of the invention that the tubular expander may be sealed to the tubular liner hanger by a plurality of annular bumps on an outer surface of the tubular expander. The tubular expander preferably has a generally cylindrical exterior surface along an axial length of the tubular expander, such that the tubular liner hanger is expanded the same amount along the axial length of the tubular expander. A stop on the tubular liner hanger may limit axial movement of the tubular expander with respect to the tubular liner hanger. One or more packer seals on the tubular liner hanger are provided for sealing with the casing string upon expansion of the tubular liner hanger, and a plurality of slips fixed on the tubular liner hanger are provided for securing the tubular hanger to the casing string when the tubular liner hanger is expanded by the tubular expander.

According to another feature of the invention, a piston is axially movable in response to fluid pressure within the running tool mandrel, and the clutch disengages in response to axial movement of the piston. A cementing plug or a ball within the running tool mandrel increases fluid pressure to the piston.

As yet another feature of the invention, the running tool includes a central mandrel with a bore for passing cement through the running tool prior to setting the liner hanger. The running tool mandrel also includes a left hand thread for releasing the running tool by right hand rotation of the work string.

In a preferred embodiment, the expander setting sleeve has a uniform diameter outer surface for expanding the hanger body, with a sleeve-shaped expander setting sleeve remaining downhole to provide radial support for the expanded liner hanger.

Another feature of the invention is that the receptacle formed by the expander sealing sleeve and the seal nipple at the lower end of the liner string functions as an expansion joint to allow for thermal expansion and compression of the liner or production tie-back.

Another feature of the invention is that the running tool may be easily and reliably released from the set liner hanger after expansion of the liner hanger. Interference between the tubular expander and the liner hanger secures the tubular expander within the liner hanger. The running tool may then be removed from the well.

An advantage of the invention is that the liner hanger may be constructed more economically than other prior art liner hangers. The assembly consists of few components. A related advantage is that many of the components of the assembly, such as slips and packer seals, may be commercially available in accordance with various downhole conditions.

Another advantage of the invention is that the system for forming a liner hanger may utilize conventional components each with a high reliability. Existing personnel with a minimum of training may reliably use the liner hanger system according to this invention since the invention relies upon well known surface operations to reliably form the liner hanger.

These and further features and advantages of the present invention will become apparent in the following detailed description, wherein reference is made to the figures in the accompanying drawings.

DETAILED DESCRIPTION OF PREFERRED EMBODIMENTS

A liner may be conveyed into the well to the desired setting or suspension depth by a drill pipe or work string connected to a multi-stage, double action hydraulic setting and releasing tool (running tool) that furnishes the necessary forces to expand the liner hanger into engagement with the casing. The running tool may be constructed of sufficiently high strength steel to support the weight of the liner as it is run into the well and to provide the necessary force to expand the liner. Additionally, the running tool has a sufficiently large internal bore in its central mandrel to enable passage and displacement of cement for cementing the liner within the well bore.

A feature of the present invention is that the liner hanger and setting tool may be furnished with an interlocking releasable mechanism to prevent rotation between the running tool mandrel and the liner to permit drilling of the liner into the well, while allowing relative rotation between the running tool mandrel and liner to accommodate release of the running tool from the liner hanger once the liner is cemented and suspended within the well from the liner hanger.

After the liner hanger is positioned at its required setting depth within the casing, cement is pumped through the work string, the running tool and the liner and into the annulus between the liner and the well bore and casing to cement the liner in the well in a manner well known in the art. During this operation, fluid in the annulus may flow upward past the unset liner hanger to accommodate the cement pumped into the well.

Figure 1A:
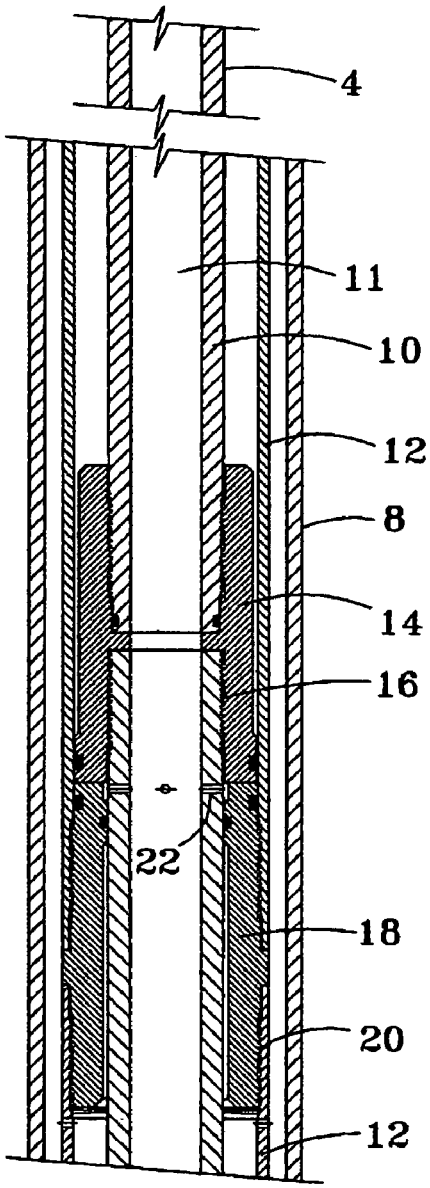
FIG. 1A depicts in cross section an upper actuator portion of the running tool.

Referring to FIG. 1A, the upper end of the running tool actuator assembly 6 may include an inner connector 14 structurally connected by threads 16 to the running tool inner mandrel 10, which in turn is structurally connected to a work string 4. A throughport 22 in the mandrel 10 below the top connector allows fluid pressure within the interior of the running tool to act on both inner connector 14 and an outer connector 18, which as shown includes conventional seals 2 for sealing between the mandrel 10 and an outer sleeve 12. A predetermined amount of fluid pressure within the running tool acting on the outer connector will thus provide downward movement of the outer sleeve 12, which is connected to the outer connector by threads 20.

Figure 1B:
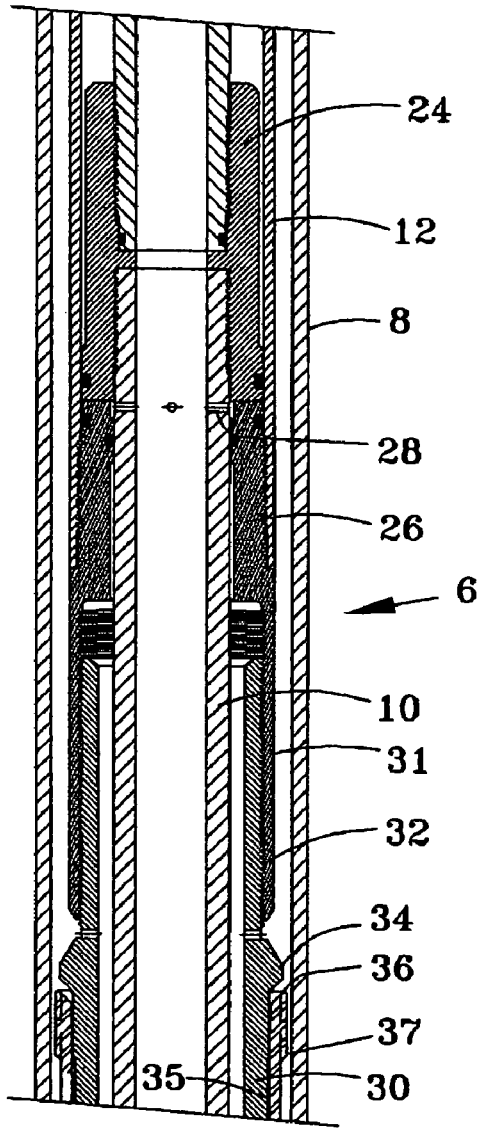
FIG. 1B depicts a lower actuator portion of the running tool and an upper portion of the sealing sleeve.

Fluid pressure to the inner connector 14 thus passes through the throughport 22, and inner connector is sealed and structurally connected to the mandrel 10. Fluid pressure thus exerts an upward force on the connector 14 and thus the mandrel 10, and also exerts a downward force on the outer connector 18 and the outer sleeve 12. FIG. 1B shows a similar inner connector 24 and outer connector 26 acting on the mandrel 10 and the sleeve 12, respectively with fluid entering through port 28. Those skilled in the art will appreciate that a series of outer connectors, inner connectors, sleeves and mandrels may be provided, so that forces effectively "stack" to create the desirable expansion forces. It is a particular feature of the present invention that a series of inner and outer connectors may exert a force on the tubular expander in excess of 1,000,000 pounds of axial force, and preferably in excess of about 1,500,000 pounds of axial force, to expand the tubular anchor.

Figure 1C:
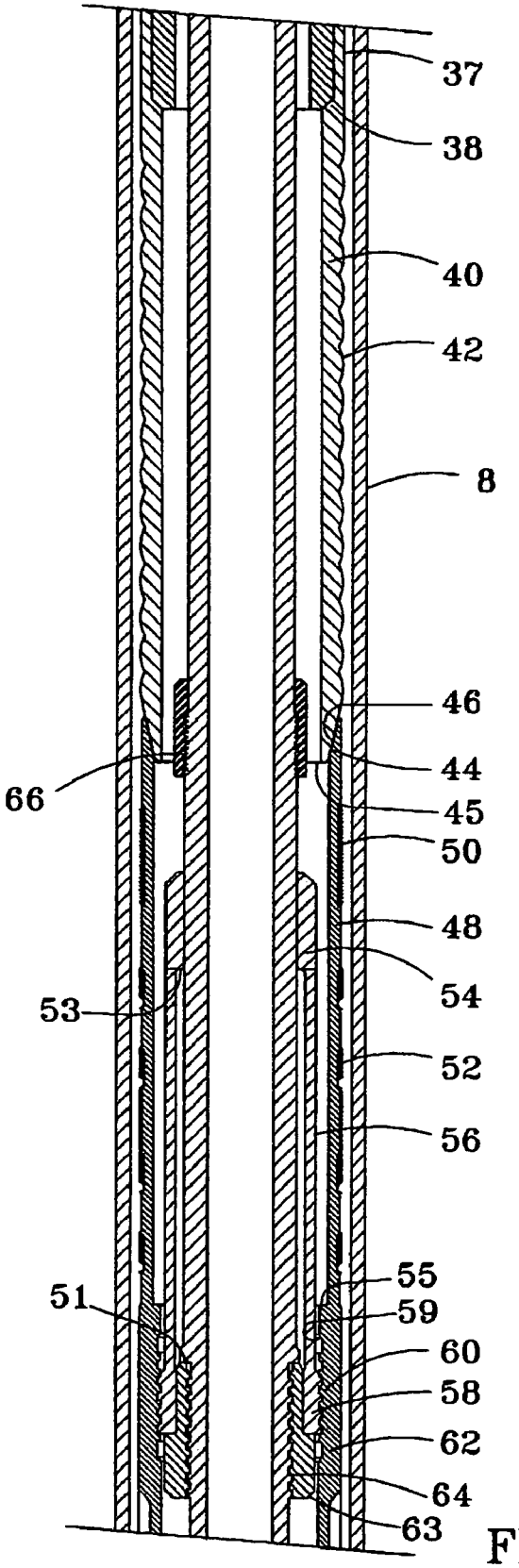
FIG. 1C depicts an expander positioned above the liner hanger.

The inner connector (inner piston), outer connector (outer piston), sleeve and running tool mandrel 10 thus define a variable size hydraulic cavity. The throughport passing through the running tool mandrel is in fluid communication with the bore 11 in the mandrel 10. Thus, as fluid pressure is introduced from within the mandrel 10 through the port and into the hydraulic cavity, the outer piston moves downward with respect to the inner piston. With the inner piston fixed to the mandrel 10 and the outer piston fixed to the sleeve 12, fluid pressure introduced into the hydraulic cavity moves the sleeve 12 downward relative to the mandrel 10 to move the tubular expander 40 downward to expand the liner hanger 48 (see FIG. 1C).

Referring to FIG. 1B, a force transfer member 34 may be threaded to and move with the sleeve 12, or to a lower sleeve 32 provided on the lowermost outer piston 26, so that the force transfer shoulder on member 34 engages the top shoulder 36 on the sealing sleeve 37 at the upper end of the tubular expander 40. Preferably, however, the lower shoulder 38 at the end of the force transfer sleeve engages a mating shoulder at the lower end of sealing sleeve 37 to more reliably move the tubular expander downward.

Thus, by hydraulically moving the force transfer member 34 downward, the tubular expander is forcibly moved at least substantially within the liner hanger to expand the liner hanger 48 into engagement with the casing string 8. The tubular force transfer member 34 as shown in FIG. 1B may thus be positioned above the tubular expander, and moves or strokes the tubular expander downward.

The sleeve 32 also acts as a setting sleeve which is adjustably supported on the force transfer member 34 and moves in a downward direction during the liner hanger setting operation. The force transfer member 34 may be adjusted downward within the setting sleeve 32 at adjusting thread 31 until the lower end of the expander is in engagement with the upper end of the liner hanger, and the lower expander taper 44 is in secure contact with the upper liner hanger body taper 46 (see FIG. 1C).

Figure 1D:
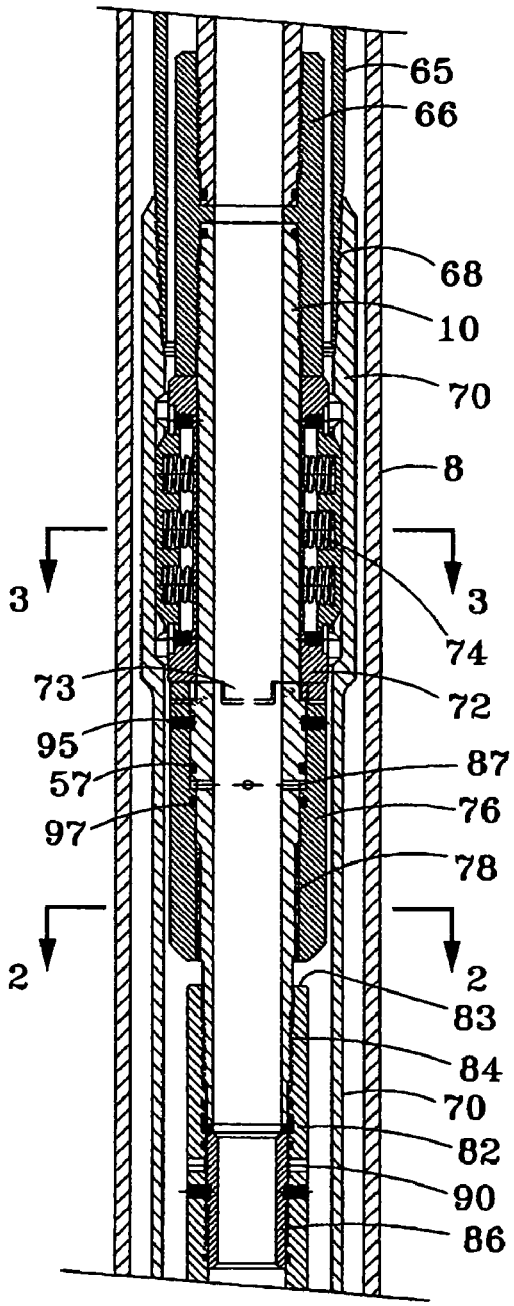
FIG. 1D depicts a mechanism for selectively rotating the liner hanger with the running tool.

After completion of the cementing operation, a setting ball is thus dropped into the drill pipe and permitted to gravitate until the ball engages the seat 86 (see FIG. 1D) at the lower end of the running tool. When seal 86 is subsequently sheared, fluid may pass through port 90 in sleeve 84. Pressure is thereafter applied to fluid within the workstring and consequently through the pressure ports 22, 28 of the mandrel 10 and into the pressure chambers formed between the upward moving pistons 14,24 and the downward moving pistons 18,26. Pressure is increased until the force created is sufficient to cause the expander 40 to move downward relative to the mandrel 10, forcing the expander 40 into the upward facing expansion receptacle of the liner hanger body 48. Forcing the expander 40 downward causes the liner hanger body 48 to expand radially, forcing slips 50 and sealing elements 52 into engagement with the inside surface of the casing, thus sealing and supporting the liner hanger within the casing.

The liner hanger assembly includes a tubular anchor 48 and a tubular expander 40 positioned above the tubular anchor when run in the well. The tubular expander has an expander outer diameter greater than the liner hanger inner diameter, such that moving the tubular expander into the liner hanger will expand the liner hanger against the casing string to seal the liner hanger with the casing string and secure the liner hanger and the tubular expander downhole in the casing string. The tubular expander may be positioned above and rest on the liner hanger prior to expansion, restraining axially downward movement of the tubular expander. The tubular anchor and expander are solid rather than perforated or slotted.

Downward movement of tubular expander 40 within the liner hanger 48 is prohibited when shoulder 45 on the lower end of expansion sleeve (see FIG. 1C) engages stop surface 55 on the tubular anchor 48. This engagement at completion of the radial expansion process causing a spike in setting pressure as an indicator of completion of the expansion process.

One or more scallops, circular arcs or circular bumps 42 on the outside of the expander sleeve 40 form a series of metal-to-metal ball seals that provide a gas tight seal between the set expander 40 and liner hanger body 48. The tubular expander preferably is a continuous sleeve-shaped member which radially supports the liner hanger once expanded. The OD and ID of the expander is substantially constant along its length (except for the annular bumps) thereby reducing the likelihood that the expander will slide out from under the set liner hanger after the running tool is retrieved to the surface.

The upper end of the expander 40 has an upward facing sealing sleeve 37 with an internal sealing surface 35 suitable for receiving a tie-back seal nipple after the liner is installed in the well. The lower portion of the tubular expander 40 may thus be positioned within the liner hanger 48 to expand the liner hanger, while the upper sealing sleeve 37 integral with the tubular expander above the shoulder 38 may be used for sealing with a seal nipple for extending the liner upward.

The liner hanger body 48 is a tubular member having elastomer, graphite or other suitable sealing elements 52 affixed about its outer circumference for sealing with the casing upon expansion of the liner hanger. A plurality of gripping members, such as slips 50, may be provided on the liner hanger for securing the liner hanger to the casing string 8 upon expansion. The upper larger internal diameter of the liner hanger provides an expansion receptacle for the tubular expander 40. The lower end of the running tool preferably engages the tubular anchor while the expander is pushed downward into the tubular anchor. The lower end of the liner hanger has a thread connection 68 for connection to the liner or other tubular components. The inner diameter of the lower portion 65 of the liner hanger which is not expanded is approximately the same as that of the liner 98. The upper end of the liner hanger has an inwardly facing taper or incline 46 that provides for overlapping internal engagement of a mating taper 44 on the bottom of the tubular expander 40. This allows the tapered end of the tubular expander to be at least partially inserted into an upper end of the liner hanger prior to expansion of the tubular anchor. The sleeve-shaped expander sleeve thus provides substantial radial support to the tubular anchor once the running tool is returned to the surface. This increased radial support to the anchor maintains fluid tight engagement between the liner hanger and casing string. The running tool may then be retrieved leaving the expander sleeve positioned radially inward of and axially aligned with the liner hanger to maintain the liner hanger in gripping engagement with the casing string.

The hydraulic running tool is connected to internal threads 59 in the liner hanger central body 62 by means of external threads 60 on releasable collet fingers 56. The collet fingers extend from collet ring 54 which is supported on running tool mandrel 10. In the running and setting position, the collet finger heads 58 are prevented from flexing inwardly by the releasing nut 63 that is connected to mandrel 10 by a left hand thread at 64. It should be remembered that the mandrel 10 of the running tool moves in an upward direction during setting of the liner hanger slips, and becomes stationary once the slips are set.

The actuator assembly of the running tool may be removed by unthreading the threaded 64 connection. The left-hand threaded connection 64 prevents undesirable unthreading of the tubular right-hand connections, which typically join tubulars and threaded components of downhole tools. The nut 63 is then free to fall or be moved from its position supporting the inner surface of the collet fingers 56. The nut 63 is caught on coupling 66 and mandrel shoulder 51 is raised to engage collet ring shoulder 53. Upward force applied to the collet ring causes the collet fingers 52 to flex inwardly moving external threads on the collet fingers from engagement with the internal threads of the liner hanger body. The running tool is then free to be removed from the set liner hanger.

A seal nipple may be inserted into the upper sealing sleeve portion 37 of the tubular expander 40, until the shoulder of the seal nipple contacts the upper end of the sealing sleeve. The lower end of the seal nipple may also engage the shoulder 38 on the expander when the sealing nipple is fully inserted into the expander. The sealing sleeve 37 of the tubular expander may be an upwardly extending sealing sleeve which is preferably integral with the upper end of expander 40 for sealing with the seal nipple. The sealing sleeve preferably has a polished cylindrical inner surface for sealing with a cylindrical outer surface of the seal nipple. Alternatively, the sealing sleeve could have a polished cylindrical outer surface for sealing with a cylindrical inner surface of the seal nipple. The seal nipple may also include an elastomeric seal, such as a Chevron seal stack, for sealing with the cylindrical inner surface of the sealing sleeve. A seal nipple may also be furnished with one or more external metal-to-metal ball seals for metal-to-metal sealing engagement with inner surface of sealing sleeve.

It is a feature of the invention that the sealing sleeve and the seal nipple form an expansion joint that allows for thermal expansion and contraction of the tubular string above the seal nipple. The internal diameter of the sealing nipple and the tubular above the sealing nipple may thus be substantially the same as the internal diameter of the tubular expander radially within the tubular anchor.

The method of setting a liner hanger according to this invention within a well is a considerable improvement over prior art hangers because radial expansion of the liner hanger body effectively closes off the annular gap between the casing and the liner, providing high pressure integrity at the top of the liner that is conventionally equal to the lesser of either the casing or the liner. Liner suspension capacity can be increased without sacrificing annular flow area by increasing the surface area of the low profile slips. Both the improvement in pressure integrity and suspension rating provide long term effect because of the expander continuously supports the liner hanger body.

Another feature of the expandable liner hanger is that there are no moving parts on the liner hanger that may become disengaged from the liner hanger body during installation of the liner in the well, thereby making it difficult or impossible to get the liner to the required setting depth. For that reason, the expandable liner hanger is particularly desirable for its adaptation for use in liner drilling operations. This is a technique for drilling the well by positioning a drill bit at the bottom of the liner and rotating the drill pipe (workstring) and liner to drill the liner into the well. In order to drill the liner into the well, relative rotation is prohibited between the liner and the running tool and drill pipe during this operation. However, relative rotation between the running tool and the liner after the liner is drilled into position and suspended from the casing is permitted in order to effect release of the running tool from the set liner hanger. Also, this technique may be used apart from a drilling position to rotate the liner and thereby more easily insert the liner into a deviated well.

Figure 2:
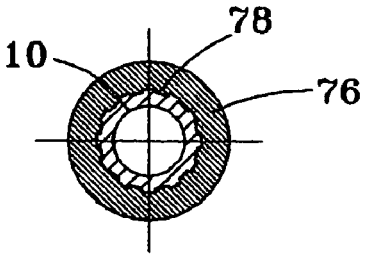
FIG. 2 is a cross section through lines 2—2 of FIG. 1D.
Figure 3:
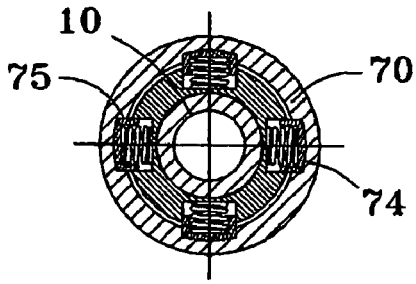
FIG. 3 is a cross section through lines 3—3 of FIG. 1D.

A torque sub 70 having axial grooves is installed as a part of the liner 98 and is positioned adjacent spring biased dogs 74 that are retained in a cage 72 that is selectively rotatable about the mandrel 10 of the running tool. More particularly, torque sub 70 is threaded at 68 with the liner hanger lower body 65. The cage 72 has lower facing clutch jaws 73 at its lower end that are interlocked with mating upper facing clutch jaws located on the upper end spline bushing 76 when the running tool is in the running position. Springs 74 allow the plugs to move radially forward and pass by the smaller diameter liner hanger before enforcing the axial grooves in the torque sub 70. The spline bushing 76 has a series of internal axial splines 78 (see FIG. 2) that slidably interconnect with external axial splines on the mandrel 10. Shear pins 95 extend through the spline bushing and engage an annular groove in the mandrel 10 to releasably secure the spline sub in an axial position to maintain engagement of the lower clutch jaws 73 and upper clutch jaws. With the running tool in the above described position, relative rotation is prevented between the cage 72 and the mandrel 10 due to the splines 78 and the clutch jaws and relative rotation is thus prevented between the running tool and the liner 98 due to dogs 74, thereby permitting the liner to be drilled into the well by rotation of the drill pipe or workstring.

A particular feature of the present invention is that the running tool includes a sufficiently large bore to allow for the reliable passage of cement and one or more cementing plugs to pass through the bore of the running tool and cement the liner in place. More particularly, the running tool preferably has an internal diameter which is at least two inches, and in many applications will have a three inch or greater internal diameter. Cement may thus be pumped from the surface through the workstring and through the liner hanger, then out the lower end of the liner and into the annulus between the liner and the borehole. Once the proper amount of cement is pumped into location, the liner hanger may be set.

After the liner is drilled into position, cemented and the liner hanger set, release from the liner hanger is accomplished by establishing relative rotation between the liner and the running tool after disengaging the clutch jaws 73 between the cage 72 and the spline bushing 76. This is accomplished through the use of hydraulic pressure applied through port 87 in the mandrel 10 into a differential pressure chamber established between mandrel seal 57 and spline bushing seal 97. Sufficient pressure is applied to create force thus necessary to break shear pins 45 and shift spline bushing 76 along mandrel 10 until spline bushing engages upper shoulder 83 of seat sub 82, which is threaded at 84 to mandrel 10. The mandrel 10 is then permitted to rotate relative to the cage 72, allowing the mandrel 10 of the running tool to be rotated relative to the releasing nut 63 to disengage the running tool from the liner hanger. During retrieval of the running tool, the dogs 74 may move radially inward as the running tool is raised upward past the set liner hanger.

Figure 1E:
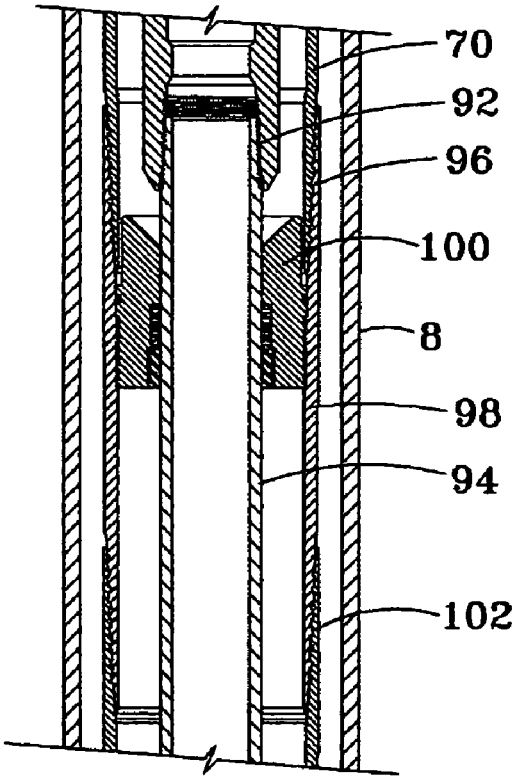
FIG. 1E depicts a lower portion of the running tool and an upper portion of a liner.

FIG. 1E shows the lower portion of the running tool and an upper portion of the liner 98, which is threaded at 96 to the lower sleeve of the sub 70. Various lengths of the liner may be threaded together, as shown at 102. The lower end of seat sub 82 is threaded at 92 to central flow tube 94, which passes cement to a lower portion of the well. Bushing 100 is provided for sealing between the central flow tube 94 and the liner hanger 98.

Figure 4:
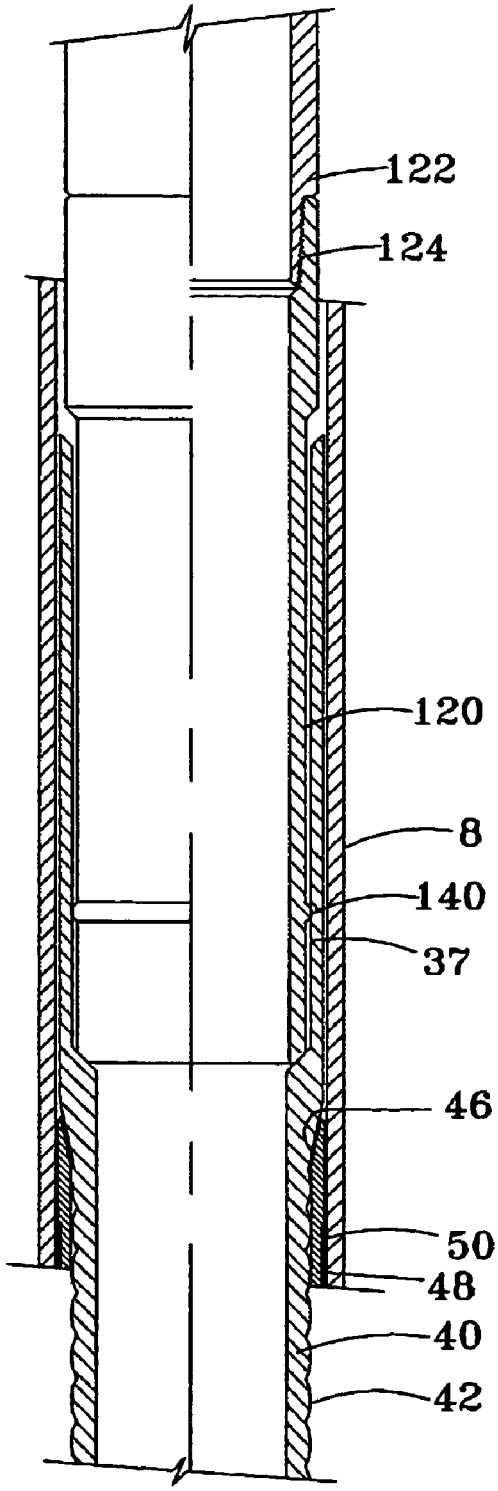
FIG. 4 depicts a set liner hanger and an upper portion of a production string extending upward from the set liner hanger.

FIG. 4 depicts a portion of the set liner hanger 48 with the tubular expander 40 therein and the sealing sleeve 37 integral with the tubular expander and extending upward from the tubular expander. A sealing nipple 120 is shown positioned within the sealing sleeve and is sealed thereto in a conventional manner, optionally by an annular metal-to-metal ball seal 140. An upper liner extension 122 with a large bore I.D. substantially equal to that of the sealing sleeve and the tubular expander is shown connected to the sealing nipple 120 at threads 124. Fluid may thus pass upward from the liner hung in the well from the liner hanger, past the tubular expander, through the sealing nipple, and upward to the surface through the liner extension.

Although specific embodiments of the invention have been described herein in some detail, this has been done solely for th purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

The invention claimed is:

1. A liner hanger for use downhole in a wellbore to seal with a casing string and support a liner on the liner hanger, the liner hanger comprising:

a tubular liner hanger removably supportable on a running tool for positioning the tubular liner hanger downhole, the tubular liner hanger having an initial hanger inner diameter, and having an initial hanger outer diameter less than an inner diameter of the casing string, the tubular liner hanger being expandable by the running tool to seal with the casing string, the liner hanger supporting the liner in the well;

a tubular expander removably supportable on the running tool, the tubular expander having an expander outermost diameter greater than the initial hanger inner diameter; and the running tool including an actuator for forcibly moving the tubular expander axially from a position substantially axially spaced from the tubular liner hanger to a position substantially within the tubular liner hanger, thereby radially expanding the tubular hanger against the casing string to secure the tubular expander and the tubular hanger downhole when the running tool is retrieved, the running tool having an internal bore for passing cement through the running tool and out a lower end of the liner.

2. A liner hanger as defined in claim 1, wherein the tubular expander is sealed to the tubular liner hanger by one or more annular bumps on an outer surface of the tubular expander.

3. A liner hanger as defined in claim 1, wherein the tubular expander has a generally cylindrical exterior surface along an axial length of the tubular expander, such that the tubular liner hanger is expanded the same amount along the axial length of the tubular expander.

4. A liner hanger as defined in claim 1, wherein a stop on the tubular liner hanger limits axial movement of the tubular expander with respect to the tubular liner hanger.

5. A liner hanger as defined in claim 1, further comprising:

one or more packer seals on the tubular liner hanger for sealing with the casing string upon expansion of the tubular liner hanger; and a plurality of slips fixed on the tubular liner hanger for securing the tubular hanger to the casing string when the tubular liner hanger is expanded by the tubular expander.

6. A liner hanger as defined in claim 1, further comprising:

one or more dogs each for engaging a slot in the liner to rotatably lock the one or more dogs to the liner; and a clutch for selectively engaging and disengaging rotation between a running tool mandrel and the one or more dogs, such that the liner rotates with the running tool mandrel when the clutch is engaged and the running tool mandrel is rotationally disconnected from the liner when the clutch is disengaged.

7. A liner hanger as defined in claim 1, wherein the running tool mandrel includes a left hand thread for releasing the running tool by right hand rotation of the work string.

8. A liner hanger for use downhole in a wellbore to seal with a casing string and support a liner on the liner hanger, the liner hanger comprising:

a tubular liner hanger removably supportable on a running tool for positioning the tubular liner hanger downhole, the liner hanger supporting the liner in the well;

a tubular expander removably supportable on the running tool, the tubular expander having an expander outermost diameter greater than an initial hanger inner diameter;

the running tool including an actuator for forcibly moving the tubular expander axially from a position substantially axially spaced from the tubular liner hanger to a position substantially within the tubular liner hanger, thereby radially expanding the tubular hanger against the casing string to secure the tubular expander and the tubular hanger downhole;

one or more dogs each for engaging a slot in the liner to rotatably lock the one or more dogs to the liner; and a clutch for selectively engaging and disengaging rotation between a running tool mandrel and the one or more dogs, such that the liner rotates with the running tool mandrel when the clutch is engaged and the running tool mandrel is rotationally disconnected from the liner when the clutch is disengaged.

9. A liner hanger as defined in claim 8, further comprising:

a piston axially movable in response to fluid pressure within the running tool mandrel, the clutch disengaging in response to axial movement of the piston.

10. A liner hanger as defined in claim 9, further comprising:

a cementing plug for passing through the running tool mandrel for increasing fluid pressure to the piston.

11. A liner hanger as defined in claim 8, wherein the running tool includes a central mandrel with a bore for passing cement through the running tool prior to setting the liner hanger.

12. A liner hanger as defined in claim 8, wherein the running tool mandrel includes a left hand thread for releasing the running tool by right hand rotation of the work string.

13. A liner hanger as defined in claim 8, wherein the tubular expander is sealed to the tubular liner hanger by one or more annular bumps on an outer surface of the tubular expander.

14. A liner hanger as defined in claim 8, wherein the tubular expander has a generally cylindrical exterior surface along an axial length of the tubular expander, such that the tubular liner hanger is expanded the same amount along the axial length of the tubular expander.

15. A method of hanging a liner in a well bore to seal with a casing string, the method comprising:

positioning an expandable tubular liner hanger and tubular expander on a running tool, the tubular liner hanger having an initial liner hanger inner diameter, and an initial liner hanger outer diameter less than an inner diameter of the casing string, the tubular expander having an expander outermost diameter greater than the initial liner hanger inner diameter, and a sealing sleeve secured to an upper end of the tubular expander;

positioning the liner hanger at a selected depth within a wellbore;

passing cement through the tubular expander and the liner to cement the liner in the wellbore; and forcibly moving the tubular expander axially to a position substantially within the tubular liner hanger to radially expand the tubular liner hanger against the casing string, thereby securing the tubular liner hanger and the tubular expander down hole.

16. A method as defined in claim 15, further comprising:

positioning the tubular expander above the tubular liner hanger prior to forcibly moving the tubular expander substantially within the tubular liner hanger.

17. A method as defined in claim 15, further comprising:

sealing the tubular expander to the tubular liner hanger by one or more annular bumps on an outer surface of the tubular expander.

18. A method as defined in claim 15, further comprising:

providing one or more packer seals on the tubular liner hanger for sealing with the casing string upon expansion of the tubular liner hanger; and fixing a plurality of slips on the tubular liner hanger for securing the tubular hanger to the casing string when the tubular liner hanger is expanded by the tubular expander.

19. A method as defined in claim 15, further comprising:

engaging one or more dogs each with a slot in the liner to rotatably lock the one or more dogs to the liner; and selectively engaging and disengaging a clutch for rotation between a running tool mandrel and the one or more dogs, such that the liner rotates with the running tool mandrel when the clutch is engaged and the running tool mandrel is rotationally disconnected from the liner when the clutch is disengaged.

20. A method as defined in claim 19, further comprising:

axially moving a piston in response to fluid pressure within the running tool mandrel to selectively disengage the clutch.

* * * * *